United States Patent [19]

Baron

[11] 4,231,666

[45] Nov. 4, 1980

[54] MIXING APPARATUS

[75] Inventor: John Baron, Accrington, England

[73] Assignee: E. T. Oakes Limited, Macclesfield, England

[21] Appl. No.: 18,102

[22] Filed: Mar. 7, 1979

[30] Foreign Application Priority Data

Mar. 10, 1978 [GB] United Kingdom ..... 9674/78

[51] Int. Cl.[3] ..... B01F 5/06; B01F 7/00

[52] U.S. Cl. ..... 366/304; 366/317

[58] Field of Search ..... 366/303, 304, 316, 317, 366/312, 313, 176, 302

[56] References Cited

U.S. PATENT DOCUMENTS

| | | | |
|---|---|---|---|
| 2,321,599 | 6/1943 | Hofmann | 366/304 |
| 2,734,728 | 2/1956 | Myers | 366/303 |
| 2,960,318 | 11/1960 | Caillaud | 366/303 |

FOREIGN PATENT DOCUMENTS

| | | | |
|---|---|---|---|
| 1390180 | 4/1975 | United Kingdom | 366/304 |

*Primary Examiner*—Robert W. Jenkins

*Attorney, Agent, or Firm*—Lewis H. Eslinger

[57] ABSTRACT

A mixing device of the type having a housing of generally cylindrical construction, having an end wall with concentric arrays of axially extending mixing elements thereon, a rotor being rotatable within the housing and having on the face thereof further axially extending mixing elements in a plurality of annular concentric arrays, the mixing elements of the rotor and housing interfitting with one another. The mixing elements themselves are each defined by inner and outer part-cylindrical surfaces and by further straight surfaces forming the sides of grooves, the axes of the grooves being disposed along different tangents to an inner pitch circle which is concentric with the part-cylindrical surfaces. This provides a much better mixing effect and produces a certain reverse pumping within the mixer. These features enable the mixing elements to be made shorter with the possibility of the rotors and end walls of the housing being formed by moulding.

15 Claims, 2 Drawing Figures

MIXING APPARATUS

Figure 1:
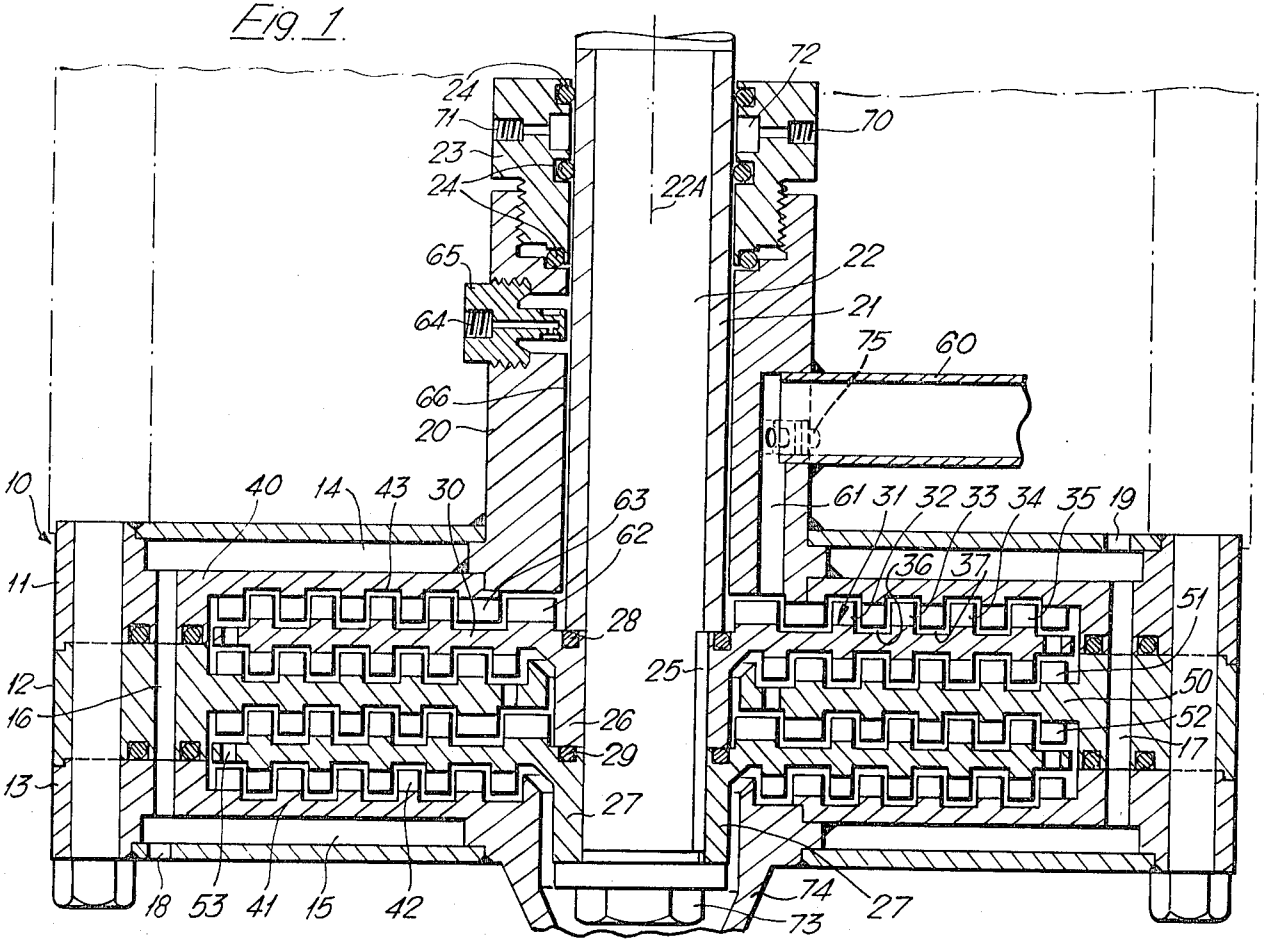

The present invention relates to mixing devices. Various forms of mixing device have been proposed over the years and one such device, which is particularly suitable for producing, amongst other things, an aerated product, such as an aerated foodstuff, foam plastics material etc., comprises a generally cylindrical housing having on its end walls a plurality of axially extending mixing elements arranged in a number of concentric annular arrays. A rotor, which is rotatable within the housing, has similar mixing elements extending axially therefrom, again in annular arrays, the mixing elements of the rotor being disposed in the spaces between the mixing elements on the end walls of the housing.

Preferably the rotor has teeth on its other axial face and these co-operate with further teeth on the other end wall of the housing. It has also been proposed to mount a number of rotors on the same shaft, and to provide the housing with intermediate walls, these intermediate walls having concentric annular arrays of teeth thereon. The material to be mixed is introduced, usually adjacent the shaft, and flows radially outwardly in a tortuous path between the teeth where it is subjected to a large shearing action.

This disperses the various ingredients intimately in one another and is particularly advantageous when one is attempting to mix a gas with a pasty or liquid substance, such as in the production of certain confectionery, chocolate, foam plastics material etc.

It is now proposed, according to the present invention, to provide a mixing device including a housing of a generally cylindrical construction, having an end wall with concentric arrays of axially extending mixing elements thereon, a rotor rotatable within the housing having on the face thereof, further axially extending mixing elements in a plurality of annular concentric arrays, the mixing elements of the rotor and housing interfitting with one another, and wherein the mixing elements of each array are each defined by inner and outer part cylindrical surfaces and by further straight surfaces forming the sides of grooves the axes of which are disposed along different tangents to an inner pitch circle which is concentric with the part-cylindrical surfaces.

Advantageously, the straight surfaces of elements in different concentric arrays lie along the same planes.

With such an arrangement, for example, the mixing elements can be formed by cutting a number of concentric grooves in the end face of the housing and in the face of the rotor, by a lathe turning operation and subsequently the straight surfaces can be formed by milling across the thus formed concentrically grooved elements along lines which are tangential to said inner circle. This enables the elements to be formed relatively cheaply.

Furthermore, the construction has three main advantages. Firstly it prevents there being any line of sight in a radial direction so that a thorough mixing can take place without there being any fear of material flowing radially inwardly or radially outwardly without passing over a large number of mixing elements. Secondly it produces angled mixing elements which have a pumping effect.

In normal mixers of this type, the material to be mixed is pumped into the apparatus by an external pump. This pump causes the material to flow, for example, first radially outwardly, then over the periphery of the rotor, and then radially inwardly; if there are a number of mixing heads on the same shaft, this is repeated. With the construction according to the present invention, the mixing elements are angled to produce what might be termed a "reverse pumping" effect. Thus, when the pump is causing the fluid to flow radially outwardly, the mixing elements are disposed so as to cause the material to tend to flow radially inwardly and vice versa. This increases the shear effect on the material being mixed.

The third main advantage arises because, with the very thorough mixing produced for the reasons outlined above, it is possible, in order to achieve at least as good a mixing effect as with conventional mixers of this type, to make the mixing elements of smaller axial length. This opens up the possibility of manufacturing the end walls, rotor and/or any intermediate walls by an injection moulding technique from plastics material. This has hitherto not been possible because the length of the mixing elements compared to their cross-section has been too great to enable accurate moulding and to enable the finished part to be removed from the mould.

With the construction according to the invention, if it is necessary to remove flash from the finished product after the moulding operation, this can readily be achieved by a light machining or "skimming" operation which can be carried out easily for the reasons indicated earlier.

As in known mixers of this type, preferably mixing elements are provided on each face of the rotor and on each end wall of the housing. Furthermore, it is also contemplated in an advantageous construction that a number of mixing chambers are provided, the housing having an intermediate wall or walls with axially extending mixing elements thereon, these co-operating with mixing elements on further rotors on the same shaft placed between the intermediate walls and between the end walls and the adjacent intermediate wall.

The housing is preferably provided with a jacket for the passage of a heat treatment fluid, either for cooling, or for heating the products during their mixing or homogenising.

It is also contemplated that the edge portions of the rotors can be provided with a number of circumferentially spaced apertures just inwardly of the edge itself of the rotor to assist in the mixing action and to facilitate the flow of fluid around the perimeter of the rotor.

Figure 2:
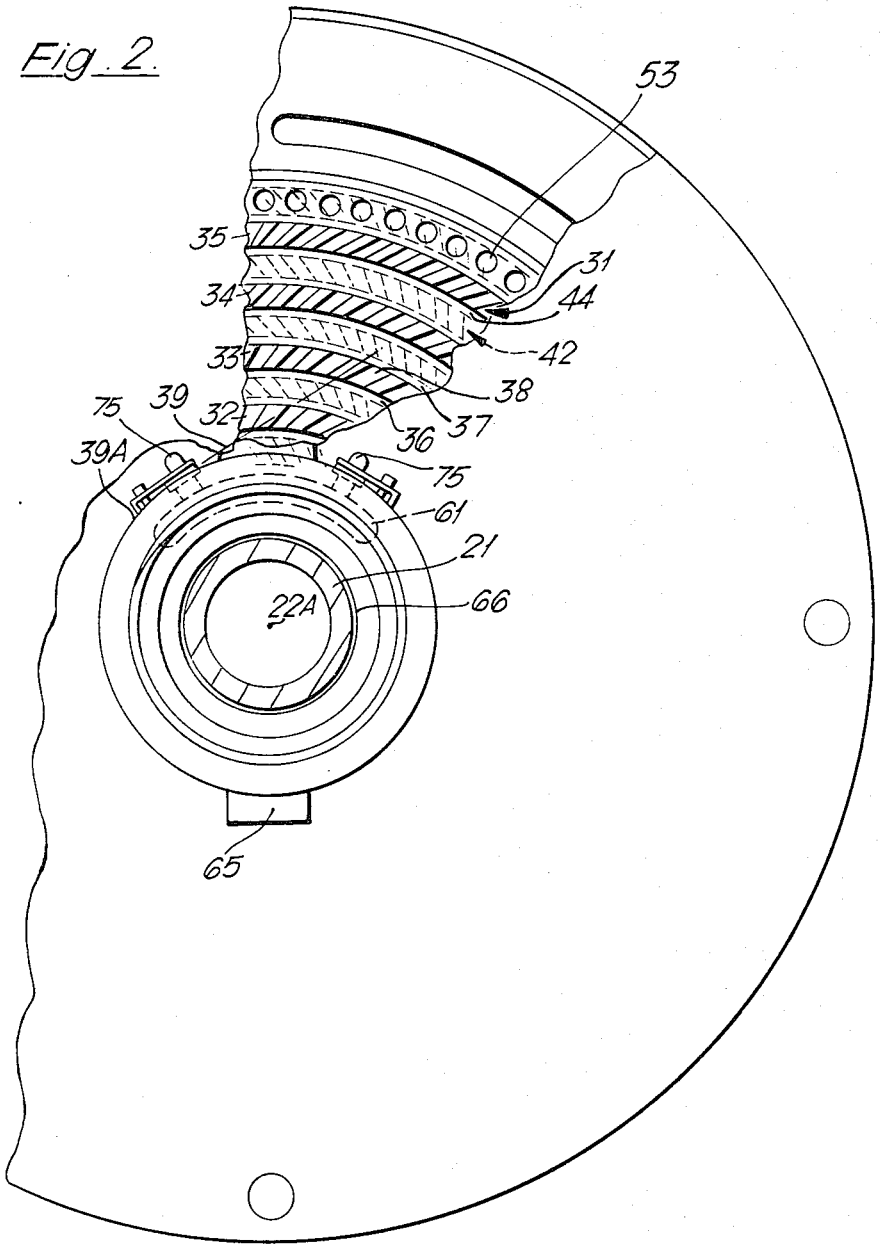

In order that the present invention may more readily be understood, the following description is given, merely by way of example, reference being made to the accompanying drawings, in which:

FIG. 1 is a cross-section through one embodiment of mixing device according to the invention; and FIG. 2 is a fragmentary view, partly in section, illustrating the structure of the mixing elements.

The device illustrated in FIG. 1 includes a housing 10 formed by three annular parts 11, 12 and 13, the parts 11 and 13 being provided with jackets 14 and 15 respectively, the jackets 14 and 15 being connected by ducts 16 and 17 extending through the annular portions of the housing. An inlet 18 is provided to the jacket 15, for a cooling or heating fluid and an outlet 19 is provided in the jacket 14 for discharge of the cooling or heating fluid.

A hub member 20 extends axially of the housing 10 from one end thereof and this has located therein a sleeve 21 having a shaft 22 rotatable within the sleeve.

A stuffing box arrangement 23 is inserted into the hub member 20 and is provided with three O-ring seals 24.

The shaft 22 is provided with a key 25 upon which is mounted a pair of rotor spinner members 26 and 27, these each having O-rings 28 and 29 at their upper ends.

The rotor spinners 26 and 27 each include a radial disc 30 which has extending from each axial face a plurality of mixing elements 31. These mixing elements can be seen more clearly in FIG. 2. From this Figure and from FIG. 1, it can be seen that the mixing elements are arranged in four annular arrays 32, 33, 34, and 35 the annular array 33, for example, being defined by two annular grooves 36 and 37, the individual elements of the array being separated from one another by grooves 38 extending in a direction which is a tangent 39 to a circle 39A centred on the axis 22A of the shaft 22. In FIG. 2, this circle is, by chance, approximately the same diameter as the hub member 20. If desired, all of the grooves of the other arrays 32, 34, and 35 can extend in a tangent to the same circle; in FIG. 2 they appear as tangents to different circles. FIG. 1, on the other hand, shows an arrangement in which there are tangents to the same circle because the elements 31 are shown in elevation, without sectioning, so that one is, in effect, looking along a line of grooves 38. It will be seen from FIG. 1 that these grooves 38 are shallower than the grooves 36 and 37.

The spinners 26 and 27, therefore, can be made by machining out from the solid by cutting the grooves 36, 37 etc. by turning on a lathe, and by cutting the tangential grooves 38 with a milling cutter.

The end walls 40 and 41 of the housing members 11 and 13 are each provided with similar arrays of axially extending mixing elements which are of a similar construction as can be seen in chain dotted lines in FIG. 2. Again annular grooves are formed therein such as the grooves 44, see FIG. 2. The actual shape of the elements 42 is thus very similar, but it will be noted that the inclination is the opposite to that of the elements 31. The result of this is that there is no line of sight in any radial or indeed tangential direction which is not interrupted by one of the mixing elements of the housing or of the rotor spinner.

Reverting to FIG. 1, again, it will be seen that the annular member 12 is provided with an intermediate wall 50 which has mixing elements 51 and 52 on opposite faces thereof, these mixing elements cooperating with similar mixing elements to the elements 31 on each of the rotor spinners.

At the periphery, the spinners are each provided with axially extending apertures 53 which are spaced circumferentially as can be seen in FIG. 2.

A product inlet pipe 60 extends radially inwardly into the hub member 21 and is connected to a product passage 61, which extends axially along the hub member to a location adjacent the nearest rotor spinner mixing element 62, which it will be noted has a greater radial extent that the remaining elements, as has the next mixing element 63 of the housing.

Located at a different position both axially and circumferentially of the hub member is a gas inlet 64 which is provided by a nozzle 65, this being connected by an axially extending annular passage 66 which passes between the sleeve 21 and the hub member 20 and also opens out adjacent the mixing element 62.

At the upper end of the stuffing box member 23 there is provided a pair of coolant conduits 70, 71 communicating with a coolant chamber 72.

At the lower end, it will be seen that the rotor spinners 26 and 27 are held in place by a nut 73 which is located within an outlet passage duct 74.

Finally an entry passage 75 is provided in the passage 60 for the introduction of an additive which may be necessary during the mixing operation.

In operation, the fluid material to be treated is introduced through the inlet 60, by any suitable pressure source, such as a pump, and at the same time an additive can be introduced at 75.

A gas under pressure is introduced at 64. With the shaft 22 and the rotor spinners 26 and 27 rotating, the material to be mixed is thus introduced near the axis of the mixer. It will then flow radially outwardly on the upper side of the spinner 26, and be subjected to the action of the mixing elements. The direction of rotation of the shaft is clockwise, as viewed in FIG. 2, so that the effect of the inclination of the mixing elements is to tend to force the product to be mixed radially inwardly somewhat against the action of the feed pump. However, the feed pump is arranged to have a greater moving force than this so that the material being mixed is steadily forced outwardly through the various mixing elements. It will flow then to the periphery of the spinner 26, some of it passing through the openings 53 and some of it around the ends. During this movement it will be subjected to very considerable shear which assists in the mixing effect. The material will then flow radially inwardly along the lower face of the rotor spinner 26, and then radially outwardly along the upper face of spinner 27 in the same manner and finally back inwardly again before being discharged through the outlet conduit 74.

It will be appreciated that the construction of the present invention is one which will not only provide a very good mixing effect, but is relatively easy to manufacture. As indicated above, the manufacturing is done by two machining operators, firstly the cutting of the annular grooves, and secondly by the milling in a tangential sense to a circle on the same centre as the axis of the rotor. Alternatively the manufacture can be effected by an injection moulding operation from a plastics material and if it is necessary a finishing light machining operation can then be carried out as indicated to remove any flash.

In use, it is possible to control the temperature of the mixing by introducing a heating or cooling fluid at 18 allowing it to discharge at 19, having passed through the jackets 15 and 14, as well as the passages 16 and 17. These passages 16 and 17 are preferably around the periphery as arcuate conduits as can be seen in FIG. 2.

I claim:

1. A mixing device comprising, in combination:

(a) a housing of generally cylindrical construction;

(b) two end walls to said housing;

(c) a shaft mounted for rotation coaxially of said cylindrical housing;

(d) means for rotating said shaft in a given direction of rotaton;

(e) a fluid inlet and a fluid outlet to said housing;

(f) means for feeding fluid to be mixed under pressure to said fluid inlet;

(g) concentric arrays of axially extending mixing elements on at least one end wall;

(h) a rotor mounted on said shaft for rotation therewith, said rotor having an end face facing said at least one end wall;

(i) further axially extending mixing elements in a plurality of annular concentric arrays on said rotor, the mixing elements of the rotor and the at least one end wall interfitting with one another, and the mixing elements of each array on said at least one end wall and said rotor each being defined by inner and outer part-cylindrical surfaces and by further straight surfaces forming the sides of grooves, the axes of which are disposed along different tangents to an inner pitch circle which is concentric with said part-cylindrical surfaces such that, upon rotation of said shaft in said given direction, a reverse pumping action is produced tending to resist the feeding of the fluid through the housing by the feeding means.

2. A mixing device as claimed in claim 1, wherein each said end wall has said mixing elements thereon.

3. A mixing device as claimed in claim 1, and further comprising an intermediate wall on said housing, said rotor being between said one end wall and said intermediate wall and further comprising a second rotor mounted between said intermediate wall and said other end wall, and wherein said rotors both have on each axial side said mixing elements of the shape specified and wherein said intermediate wall has said mixing elements thereon on each axial side interfitting with those on the adjacent axial side of the two rotors.

4. A mixing device as claimed in claim 1, wherein the straight surfaces of the elements in different concentric arrays of the rotor or stator lie along the same plane.

5. A mixing device as claimed in claim 1 wherein said inlet is adjacent said shaft on one axial side of said rotor and said outlet is adjacent said shaft on the other axial side of the rotor whereby fluid to be mixed flows radially outwardly to the periphery of said housing and then radially inwardly before discharging through said outlet.

6. A mixing device as claimed in claim 1 and further comprising means defining a plurality of circumferentially spaced apertures passing through said rotor and located just inwardly of the edge thereof.

7. A mixing device as claimed in claim 1 wherein the straight surfaces of the mixing elements on the rotor are inclined along a tangent in the opposite rotational sense from those on the housing.

8. A mixing device comprising, in combination:

(a) a housing of generally cylindrical construction;

(b) stator means comprising at least one stator;

(c) a shaft mounted for rotation coaxially of said cylindrical housing;

(d) means for rotating said shaft in a given direction of rotation;

(e) a fluid inlet and a fluid outlet to said housing;

(f) means for feeding fluid to be mixed under pressure to said fluid inlet;

(g) concentric arrays of axially extending mixing elements on the stator means;

(h) a rotor mounted on said shaft for rotation therewith, said rotor having an end face facing said stator means;

(i) further axially extending mixing elements in a plurality of annular concentric arrays on said rotor; the mixing elements of the rotor and the stator means interfitting with one another, and the mixing elements of the rotor having leading and trailing edges which are inclined so that, upon rotation of said shaft in said given direction, a reverse pumping action is produced tending to resist the feeding of the fluid through the housing by the feeding means.

9. A device according to claim 8 wherein mixing elements of each array on said at least one stator and said rotor each are defined by inner and outer part-cylindrical surfaces and by further straight surfaces forming the sides of grooves, the axes of which are disposed along different tangents to an inner pitch circle which is concentric with said partcylindrical surfaces.

10. A mixing device as claimed in claim 9, wherein said stator means includes a plurality of stators two of which constitute end walls of the housing and one of which constitutes an intermediate wall of said housing, said rotor being between one end wall and said intermediate wall and further comprising a second rotor mounted between said intermediate wall and said other end wall, and wherein said rotors both have on each axial side said further axially extending mixing elements and wherein said intermediate wall has said respective mixing elements thereon on each axial side interfitting with those on the adjacent axial side of the two rotors.

11. A mixing device as claimed in claim 9, wherein the straight surfaces of the elements in different concentric arrays of the rotor or stator lie along the same plane.

12. A mixing device as claimed in claim 9 wherein the straight surfaces of the mixing elements on the rotor are inclined along a tangent in the opposite rotational sense from those on the housing.

13. A mixing device as claimed in claim 8, wherein each said stator has said mixing elements thereon.

14. A mixing device as claimed in claim 8 wherein said inlet is adjacent said shaft on one axial side of said rotor and said outlet is adjacent said shaft on the other axial side of the rotor whereby fluid to be mixed flows radially outwardly to the periphery of said housing and then radially inwardly before discharging through said outlet.

15. A mixing device as claimed in claim 8 and further comprising means defining a plurality of circumferentially spaced apertures passing through said rotor and located just inwardly of the edge thereof.

* * * * *